United States Patent [19]

Lampe et al.

[11] 4,249,844

[45] Feb. 10, 1981

[54] APPARATUS FOR ACCUMULATING STACKS OF NOTE BOOKS OR THE LIKE

[75] Inventors: Siegfried Lampe, Ellerbek; Siegmar Neubüser, Hamburg, both of Fed. Rep. of Germany

[73] Assignee: E. C. H. Will (GmbH & Co.), Hamburg, Fed. Rep. of Germany

[21] Appl. No.: 13,625

[22] Filed: Feb. 21, 1979

[30] Foreign Application Priority Data

Mar. 2, 1978 [DE] Fed. Rep. of Germany ..... 2808948

[51] Int. Cl.[3] ..... B65G 57/06; B65H 29/34; B65H 31/30

[52] U.S. Cl. ..... 414/45; 53/537; 271/189; 271/299; 414/52; 414/82; 414/900

[58]. Field of Search ..... 414/45, 52, 76, 82, 414/900; 271/189, 192, 223, 299; 93/93 DP; 53/260, 537, 540

[56] References Cited

U.S. PATENT DOCUMENTS

| | | | |
|---|---|---|---|
| 2,622,876 | 12/1952 | Schefe | 414/82 X |
| 3,205,794 | 9/1965 | Califano et al. | 414/52 X |
| 3,566,576 | 3/1971 | Ayres et al. | 53/540 X |
| 3,593,860 | 7/1971 | Brenner | 271/189 X |
| 3,670,474 | 6/1972 | Vieson et al. | 53/540 X |

*Primary Examiner*—L. J. Paperner
*Attorney, Agent, or Firm*—Peter K. Kontler

[57] ABSTRACT

Apparatus for accumulating discrete stacks of superimposed note books has a feeding conveyor which delivers note books seriatim into each of a battery of receptacles forming a row which extends transversely of the direction of feed of note books. Each receptacle has a composite bottom wall with two elongated horizontal carriers which are movable sideways toward and away from each other to constitute a platform for an oncoming note book in those positions in which they are closer to each other and to provide an opening for gravitational descent of a note book onto a stacking table therebelow in those positions in which they are more distant from each other. The carriers are parallel to the direction of feed of note books into the respective receptacles, one carrier of each bottom wall is connected to a first reciprocable support, and the other carrier of each bottom wall is connected to a second reciprocable support. The supports form part of a parallel motion mechanism which is actuatable by a double-acting pneumatic cylinder and piston unit to move the carriers of each bottom wall toward and away from each other. The cylinder and piston unit is actuated in response to signals transmitted by a photocell which monitors the feed of note books to the receptacles. The stacking station accommodates a vertically movable table which supports the growing stacks and is caused to descend upon accumulation of complete stacks to thereby deposit the fully grown stacks onto the upper reaches of belts forming part of a take-off conveyor.

7 Claims, 2 Drawing Figures

APPARATUS FOR ACCUMULATING STACKS OF NOTE BOOKS OR THE LIKE

BACKGROUND OF THE INVENTION

Apparatus for stacking groups of sheets of paper or the like, hereinafter referred to as "pads" for the sake of brevity, and for transporting the stacks on to a further processing station are used in production lines for the making of books of all types and the like. Such apparatus may receive pads from a foil-applying tunnel where a transparent plastic foil, previously wrapped around each pad, is caused to shrink as a result of the application of heat which results in a close fit of each foil around the respective pad. The pads are then stacked until a predetermined number of superimposed or overlapping pads is obtained, and the stacked pads are delivered to a packing apparatus or to another processing unit.

In known apparatus of this kind, receptacles for wrapped pads are disposed above a stacking table, and each receptacle is provided with pivotable bottom panels which intercept an oncoming pad and are thereupon pivoted to open positions so as to enable an intercepted pad to descend onto the stacking table. The receptacles are adjustable to accept different formats and sizes of pads; this contributes to the initial and maintenance cost of such receptacles due to complexity of adjustable drive means for the bottom panels. An even more serious drawback of conventional apparatus of the just outlined character is that the number of receptacles determines the number of parallel tracks realizable in the entire production line; thus, the entire width of the conveyor line cannot be effectively used by an appropriate increase of tracks when the processing of relatively wide pads is followed by the processing of narrower or very narrow pads.

OBJECTS AND SUMMARY OF THE INVENTION

An object of the invention is to provide an apparatus which can simultaneously accumulate two or more stacks of note books, pads or similar piles of overlapping sheets, and which can be rapidly converted for stacking of wider, narrower, longer or shorter piles.

Another object of the invention is to provide an apparatus wherein the number of receptacles for discrete piles of sheets can be varied within a wide range.

A further object of the invention is to provide an apparatus which can stack piles of sheets at full capacity even if the dimensions of piles which are about to be treated greatly deviate from the dimensions of piles under treatment.

An additional object of the invention is to provide the apparatus with novel and improved means for operating the moving parts of receptacles and other components in a predetermined sequence to insure that the accumulation of stacks of requisite dimensions takes up little time.

A further object of the invention is to provide the apparatus with novel and improved means for evacuating accumulated stacks from the stacking station.

An additional object of the invention is to provide the apparatus with novel and improved receptacles for temporary storage of piles of sheets on their way to the stacking station.

Another object of the invention is to provide the apparatus with novel and improved means for insuring predictable orientation of piles of sheets in the receptacles.

The invention is embodied in an apparatus for accumulating sheets into stacks, particularly for accumulating piles of sheets (e.g., note books or pads which may but need not be confined in transparent or translucent envelopes) into larger stacks. The apparatus comprises a plurality of receptacles each having a bottom wall including substantially parallel first and second portions (e.g., elongated carriers in the form of rods, strips or bars) of which at least the first portion is movable toward and away from the respective second portion between a first position in which the bottom walls can support piles of sheets from below and a second position in which the piles of sheets are free to leave the respective receptacles by gravity, a system of belts or other suitable means for feeding piles of sheets to the receptacles in the first positions of the first bottom wall portions so that the piles come to rest on the respective bottom walls, means for transporting the first portions of the bottom walls between the first and second positions including support means for the first portions of the bottom walls and a fluid-operated motor or analogous means for moving the support means to thereby move the first portions between the first and second positions, and means for intercepting the descending piles of sheets at a level below the receptacles so that the intercepted piles accumulate on top of each other and form discrete stacks, one below each receptacle. The intercepting means may comprise a platform or table which is movable up and down and intercepts the descending piles of sheets in its raised position while transferring fully grown stacks onto a set of continuously running belt conveyors during movement to the lower position.

The delivery of piles into the receptacles is monitored by a photocell or the like whose signals are utilized to operate the means for transporting the first portions of bottom walls and the means for moving the table in a desired sequence.

The second portions of the bottom walls can be mounted on second support means which is movable in synchronism with the first mentioned support means. The portions of the bottom walls are detachable from and adjustable relative to the corresponding support means to allow for a change in the number and/or dimensions of bottom walls.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
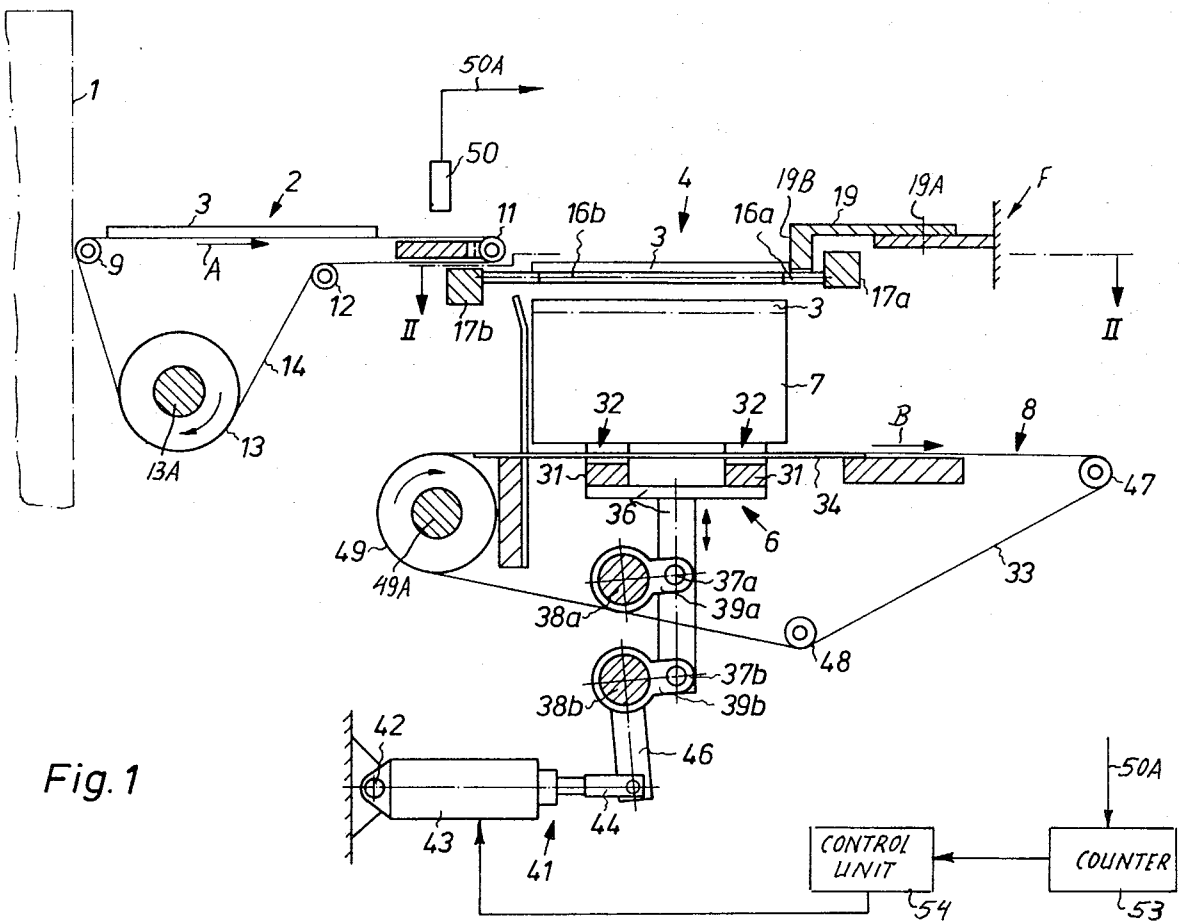
FIG. 1 is a partly diagrammatic longitudinal vertical sectional view of an apparatus which embodies the invention.

Referring first to FIG. 1, there is shown an apparatus which serves to accumulate discrete pads 3 (i.e., relatively small piles of overlapping sheets consisting of paper or the like) into groups 7 (hereinafter called stacks). The apparatus comprises a conventional draping station which receives several pads 3 at a time and applies to each pad an envelope consisting of light-transmitting synthetic thermoplastic material in a manner not forming part of the invention. The thus draped pads 3 are introduced into a tunnel 1 (indicated by phantom lines) wherein the envelopes are shrunk onto the respective pads so as to closely follow the outlines of and to confine the respective piles of sheets.

Figure 2:
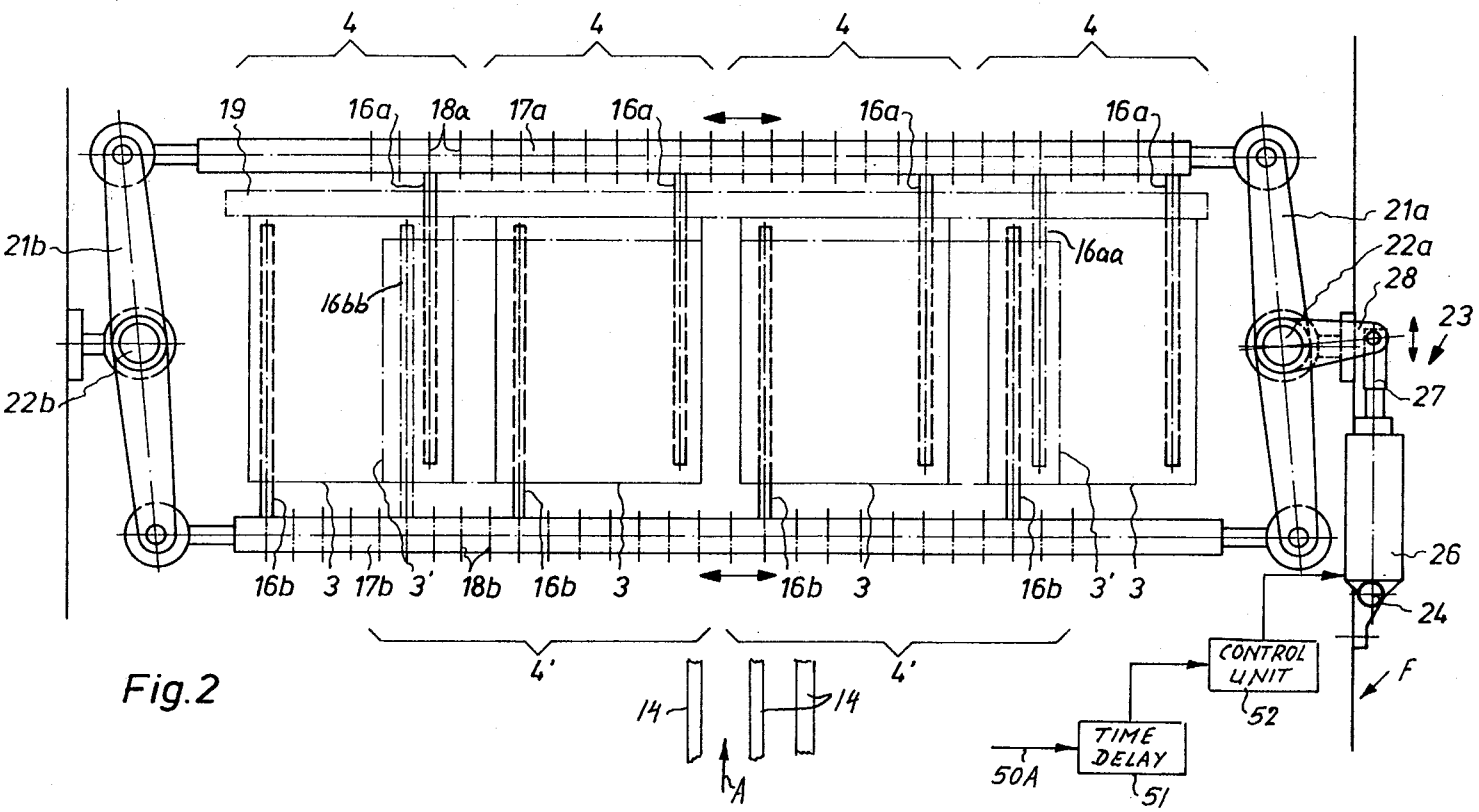
FIG. 2 is a fragmentary plan view of a detail as seen in the direction of arrows from the line II—II of FIG. 1.

The tunnel 1 discharges several pads 3 (each such pad is provided with a plastic envelope) onto the endless flexible elements or belts 14 of a feeding conveyor 2 whose upper reach advances in the direction indicated by arrow A. The belts 14 are trained over pulleys 9, 11, 12 and 13. The pulley 13 is driven by a suitable prime mover (not shown) through the medium of a transmission including the shaft 13A so that the feeding conveyor 2 is in motion at all times and immediately accepts and advances an entire row of, for example, four aligned pads toward discrete receptacles 4 which are constructed and assembled in accordance with a feature of the present invention. As shown in FIG. 2, the four receptacles 4 are disposed one adjacent to the other, as considered at right angles to the plane of FIG. 1, i.e., at right angles to the direction (arrow A) of transport of pads 3 by the upper reaches of the belts 14. The belts 14 are located in parallel vertical planes and are sufficiently close to each other to insure reliable delivery of narrow, medium-wide or very wide pads.

The receptacles 4 are mounted at a level above an intercepting device here shown as a stacking table or platform 6 which accumulates discrete stacks 7 of pads 3, one below each receptacle 4, and the fully grown stacks are transported away from the table 6 by a take-off conveyor 8 which moves the stacks in the direction indicated by arrow B, i.e., in the direction in which the pads 3 are delivered to the respective receptacles.

Each receptacle 4 comprises two elongated rod-like or strip-like carriers **16*a*, 16*b* which are parallel to each other and to the directions indicated by arrows A and B. The carriers 16*a* of all four receptacles 4 are detachably and adjustably coupled (e.g., by screws or bolts and nuts) to a horizontal support 17*a* which extends at right angles to the plane of FIG. 1, and the carriers 16*b* of all receptacles 4 are detachably and adjustably coupled to a second horizontal support 17*b* which is parallel to the support 17*a*. It will be noted that the carriers 16*b* extend forwardly from their common support 17*b*, i.e., in the direction indicated by the arrow A, and that the carriers 16*a* extend rearwardly from the common support 17*a***.

The carriers **16*a*, 16*b* of each receptacle 4 constitute a simple bottom wall on which an oncoming pad 3 comes to rest prior to being allowed to descend by gravity onto the stacking table 6** or onto a pad therebelow.

The support **17*b* is adjacent to and is located at a level below and slightly upstream of the pulley 11 for the foremost portions of the belts 14. The support 17*a* is coplanar with the support 17*b* and is located at a level below and slightly downstream of a stop 19 which is preferably adjustably secured to the frame or housing F of the apparatus, as at 19A. The stop 19 may consist of several discrete components, or it may constitute a single (one-piece) part which extends transversely along the full width of the apparatus (see FIG. 2). The pads 3 which are propelled by the belts 14 and advance over and beyond the pulley 11 to thereupon slide along the respective pairs of carriers 16*a*, 16*b* come to rest when their leading edges engage the adjacent surface 19B of the stop 19. The latter insures that the pads 3 which form the stacks 7 on the table 6 are neatly aligned with each other, i.e., that each upper pad 3** fully overlies the pad therebelow.

FIG. 2 shows that each of the supports **17*a*, 17*b* is formed with a large number of vertical holes or bores 18*a*, 18*b* which can receive screws or bolts and nuts to separably couple the corresponding carriers 16*a*, 16*b* in selected positions. This enables an attendant to rapidly convert the apparatus from simultaneous assembly of four stacks 7 (the number of stacks equals the number of receptacles 4) to simultaneous assembly of two, three, five, six or more stacks. FIG. 2 shows the manner in which the apparatus can be converted from simultaneous assembly of pads into four stacks 7 each of which consists of relatively narrow pads (as considered in a direction at right angles to the plane of FIG. 1 or in a direction from the left to the right, as viewed in FIG. 2) to simultaneous assembly of two stacks each of which consists of relatively wide pads. This involves replacing the four receptacles 4 with two relatively wide receptacles 4'** in the following way:

The two outermost carriers **16*a* of FIG. 2 are removed and the carrier of the third receptacle 4 (as counted in a direction from the left) is shifted to the phantom-line position 16*aa*. Similarly, the two outermost carriers 16*b* are removed and the carrier 16*b* of the second receptacle (again, as counted in a direction from the left) is moved to the phantom-line position 16*bb*. This results in conversion of the illustrated apparatus with four receptacles 4 into an apparatus with two wider receptacles 4' for pads 3'. Analogously, each of the supports 17*a* and 17*b* can be coupled with three, five or more suitably distributed carriers 16*a* and 16*b* respectively to convert the illustrated apparatus into an apparatus with three, five or more receptacles, depending on the width of pads which are delivered by the belts 14 of the feeding conveyor 2**.

It is further clear that the holes **18*a*, and 18*b* and the aforementioned screws or bolts and nuts can be replaced with other types of means for separably and/or adjustably coupling a requisite number of carriers to each support. Thus, the illustrated coupling means can be replaced with suitable clamps which are attached to the carriers 16*a*, 16*b* and frictionally engage the respective supports 17*a*, 17*b*** so as to allow for movement of each carrier between a practically infinite number of different positions. The just mentioned clamps may comprise pairs of leaf springs provided with protuberances which snap into suitable detent notches of the corresponding supports. All that counts is to enable an attendant to rapidly change the number of receptacles and to select the width of each receptacle in such a way that it can properly support a pad.

The means for transporting associated pairs of carriers **16*a*, 16*b* toward or away from each other through the medium of corresponding supports 17*a* and 17*b* is shown in FIG. 2. The left-hand end portions of the supports 17*a*, 17*b*, as viewed in FIG. 2, are articulately connected to the corresponding arms of a first two-armed lever 21b which is fulcrumed in the frame F, as at 22b, substantially midway between the supports. The right-hand end portions of the supports 17a, 17b are connected to the respective arms of a second two-armed lever 21a which is also fulcrumed in the frame, as at 22a. The means for pivoting the lever 21a and for thereby moving the supports 17a, 17b substantially lengthwise, i.e., transversely of the direction indicated by the arrow A or B, comprises a motor, preferably a fluid-operated motor 23, which is mounted in the frame F. The motor 23 comprises a pneumatic or hydraulic (preferably pneumatic) cylinder and piston unit having a double-acting cylinder 26 which is articulately connected with the frame F by a pivot pin 24, a piston (not shown) which is reciprocable in the cylinder, and a piston rod 27 which is connected with the piston and is coupled to the free end of an arm 28 rigid with the lever 21a. When the lever 21a is pivoted clockwise, as viewed in FIG. 2, the carriers 16a are moved away from the associated carriers 16b, i.e., the width of the space between each pair of associated carriers increases to a value which exceeds the width of a pad 3. Therefore, the pads 3 are free to leave the respective receptacles 4 by gravity and to descend onto the stacking table 6 or onto the uppermost pads of the partly assembled stacks 7 on the table 6. The motor 23 thereupon pivots the lever 21a counterclockwise so that the distance between each pair of associated carriers 16a, 16b decreases to a value which is less than the width of a pad. The receptacles 4 are then ready to accept fresh pads 3 which are supplied by the upper reaches of the belts 14**.

The levers 21a, 21b and the supports 17a, 17b constitute a parallel motion mechanism which insures that the movements of carriers 16a in one direction (to the left or to the right, as viewed in FIG. 2) are identical with movements of the carriers 16b in the opposite direction. The illustrated motor 23 can be replaced with another motor, e.g., a rotary electromagnet or another reversible electric motor of any known design.

The table 6 for stacks 7 comprises two parallel horizontal beams 31 which are mounted in the frame F at a level below the receptacles 4. The distance between the upper sides of the beams 31 and the undersides of the carriers 16a, 16b at least equals the maximum contemplated height of the stacks 7. The upper sides of the beams 31 have recesses or notches 32 for the upper reaches of endless flexible belts 33 forming part of the take-off conveyor 8. Furthermore, the beams 31 have sheet metal guides 34 which support the upper reaches of the belts 33 in the region of the table 6.

During accumulation of stacks 7, the beams 31 of the table 6 are held in the raised or upper end positions of FIG. 1. When the accumulation of stacks is completed, the beams 31 are lowered so that the fully grown stacks 7 come to rest on the belts 33 and are removed from the stacking station by advancing in the direction indicated by the arrow B. The means for moving the beams 31 between the illustrated upper end positions and lower end positions (in which the recesses 32 are located at a level below the upper reaches of the belts 33) comprises a substantially T-shaped holder 36 whose upper portion or crosshead is rigid with the beams 31 and whose vertical portion or web is connected with two one-armed levers 39a, 39b by two pivot pins 37a, 37b. The levers 39a, 39b are respectively pivotable on or with fixedly mounted horizontal shafts 38a, 38b. The lower lever 39b is rigidly connected with a downwardly extending arm 46 which is articulately connected to the piston rod 44 of a second fluid-operated motor 41. The double-acting cylinder 43 for the piston rod 44 is coupled to the frame F by a horizontal pivot pin 42. When the motor 41 is actuated in a direction to expel the piston rod 44 from the cylinder 43, the levers 39a, 39b cause the holder 36 to move the beams 31 to the upper end positions of FIG. 1. When the cylinder 43 is thereupon caused to retract the piston rod 44, the levers 39a, 39b pivot clockwise, as viewed in FIG. 1, and lower the beams 31 so that the fully grown stacks 7 come to rest on the upper reaches of the belts 33.

The belts 33 are trained over pulleys 47, 48 and 49. One of the pulleys, e.g., the pulley 49, is driven by a motor through the medium of the shaft 49A so that the belts 33 are continuously in motion.

The apparatus further comprises a control system including monitoring means in the form of a reflection type photocell 50 which is installed at a level above the upper reaches of the belts 14 to detect successive pads 3 of at least one file of pads issuing from the tunnel 1. The photocell 50 transmits signals on detection of the trailing edges of pads 3 in the path therebelow. The signal denotes that a pad 3 has advanced beyond the photocell 50 and is on its way toward the stop 19, i.e., into the interior of the respective receptacle 4. The apparatus can comprise several photocells 50, one for each receptacle 4. However, and since the draping apparatus including the tunnel 1 can be readily designed to simultaneously discharge several pads 3 which are aligned with each other, as considered at right angles to the plane of FIG. 1, it normally suffices to provide a single photocell. Each pad 3 which advances beyond the monitoring station including the photocell 50 is caused to move all the way into abutment with the stop 19. Each such pad abuts against the stop 19 and its lateral marginal portions rest on the corresponding carriers 16a, 16b.

The operation is as follows:

The pulleys 13 and 49 drive the belts 14 and 33 at a constant speed. The signal which is transmitted by the photocell 50 via conductor 50A on detection of the trailing edge of a pad 3 therebelow is delayed by a conventional time-delay device 51 which thereupon transmits a signal to the control unit 52 for the motor 23. The delay is sufficient to insure that the pads of a set of aligned pads 3 enter the respective receptacles 4 and abut against the stop 19 before the motor 23 causes the levers 21a, 21b to pivot clockwise, as viewed in FIG. 2, so as to move the carriers 16a and 16b laterally of and away from the pads in the receptacles. This enables the pads to descend by gravity onto the upper sides of the beams 31 or onto the uppermost pads which are already deposited on the beams 31. The control unit 52 thereupon actuates the cylinder 26 to return the carriers 16a, 16b to the positions of FIG. 2 so that the carriers are ready to intercept the next set of pads 3.

The signals which are generated by the photocell 50 are further transmitted to a counter 53 which is connected with the control unit 54 for the motor 41. The output of the counter 53 transmits a signal in response to reception of a predetermined number of signals from the photocell 50, i.e., a number which matches the desired number of pads 3 in a fully assembled stack 7. The control unit 54 then actuates the motor 41 to lower the beams 31 so that the fully assembled stacks 7 descend onto the upper reaches of the belts 33 and are transported from the stacking station on to the next processing station, e.g., into a packing machine, not shown.

The control unit 54 causes the motor 41 to return the beams 31 to the upper end positions with a delay which suffices to insure that the fully grown stacks 7 leave the stacking station before the upper surfaces of the beams 31 move to a level above the upper reaches of the belts 33. The counter 53 is reset to zero in automatic response to transmission of a signal to the control unit 54 so that the apparatus is then ready to start the accumulation of the next group of stacks 7.

An important advantage of the improved apparatus is that the bottom walls of the receptacles 4 or 4' need not be pivotally mounted in the frame. This simplifies the conversion of apparatus from a structure with a first number of receptacles into a structure having a different second number of receptacles. The carriers 16*a*, 16*b* are simple bars, rods or strips which are secured to the respective common supports in a simple way and by resorting to inexpensive coupling means so that the conversion of apparatus takes up a minimum amount of time and can be carried out by resorting to rudimentary tools.

Another important advantage of the improved apparatus is that the number of receptacles can be varied within a wide range. Thus, and as explained above, the number of receptacles can be reduced from four to two by the simple expedient of removing one pair of carriers 16*a*, by removing one pair of carriers 16*b*, and by shifting one of each of the remaining carriers 16*a*, 16*b* to the positions 16*aa* and 16*bb*. It will be readily appreciated that the conversion of apparatus into one having three, five or more receptacles is just as simple. The conversion into an apparatus with a larger number of receptacles merely involves addition of one or more pairs of carriers 16*a*, 16*b* and possibly some shifting of the previously used carriers in the longitudinal direction of the respective common supports 17*a*, 17*b*. Such conversion does not necessitate any adjustment or replacement of the means (23 and/or 41) for moving the supports 17*a*, 17*b* and/or for lifting or lowering the table 6.

The improved apparatus is susceptible of many modifications without departing from the spirit of the invention. For example, the support 17*a* and/or 17*b* can be replaced with several discrete supports which may but need not receive motion from a common prime mover. The illustrated construction (with a single common support 17*a* for the carriers 16*a* and a single common support 17*b* for the carriers 16*b*) is preferred at this time because it contributes to simplicity and compactness of the apparatus.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. Apparatus for accumulating sheets into stacks, particularly for accumulating piles of sheets into larger stacks, comprising a plurality of receptacles each having a bottom wall including substantially parallel elongated first and second portions, said first portion of each bottom wall being movable toward and away from the respective second portion and said second portion of each bottom wall being movable toward and away from the respective first portion between a first position in which said bottom walls can support piles of sheets and a second position in which the piles of sheets are free to leave the respective receptacles by gravity; means for feeding piles of sheets to said receptacles in the first positions of said portions including conveyor means operative to transport piles of sheets to said receptacles in a predetermined direction which is substantially parallel to the longitudinal directions of said portions of said bottom walls; means for transporting said portions of said bottom walls between said positions, including first support means for said first portions, second support means for said second portions and means for simultaneously moving said first and second support means so as to move said portions of said bottom walls toward each other during movement of said portions to said first positions and apart during movement of said portions to said second positions; means for intercepting the descending piles of sheets at a level below said receptacles so that the intercepted piles accumulate on top of each other to form discrete stacks, one below each receptacle; and means for separably coupling said portions of said bottom walls to the respective support means so as to permit for adjustment of said portions of said bottom walls transversely of said direction.

2. The apparatus of claim 1, wherein said first support means comprises a first common support for all of said first portions and said second support means comprises a second common support for all of said second portions of said bottom walls.

3. The apparatus of claim 2, wherein said common supports are substantially parallel to each other and extend substantially transversely of said portions of said bottom walls, said moving means comprising a pair of levers each articulately connected to each of said common supports and forming therewith a parallel motion mechanism, and means for deforming said mechanism to thereby move said first and second portions of said bottom walls toward and away from each other.

4. The apparatus of claim 3, wherein each of said levers has a first arm articulately connected to one of said common supports and a second arm articulately connected to the other of said common supports, and further comprising means defining fixed pivot axes for said levers intermediate said common supports.

5. The apparatus of claim 2, wherein said common supports extend substantially transversely of said direction and one thereof is nearer to said feeding means than the other of said common supports, and further comprising stop means adjacent said other common support and located in the path of movement of piles of sheets which are supplied by said feeding means to arrest such piles in predetermined positions with respect to the corresponding receptacles.

6. The apparatus of claim 2, wherein said common supports extend substantially transversely of said direction and said conveyor means comprises a plurality of endless flexible elements having portions adjacent to said receptacles, one of said common supports being adjacent to and located at a level below said portions of said flexible elements.

7. The apparatus of claim 1, further comprising means for monitoring the piles of sheets which are supplied by said feeding means and for actuating said moving means with a predetermined delay following detection of piles of sheets on said feeding means so that said first portions of said bottom walls are moved to said second positions upon delivery of piles of sheets into the respective receptacles.

* * * * *